US006125508A

United States Patent [19]

Formenti

[11] Patent Number: 6,125,508

[45] Date of Patent: Oct. 3, 2000

[54] SNAP-ACTION HINGE FOR FURNITURE DOORS

[75] Inventor: Giancarlo Formenti, Milan, Italy

[73] Assignee: Formenti & Giovenzana S.p.A., Milan, Italy

[21] Appl. No.: 09/025,658

[22] Filed: Feb. 18, 1998

[51] Int. Cl.[7] ..... E05D 11/10

[52] U.S. Cl. ..... 16/335; 16/280; 16/278

[58] Field of Search ..... 16/335, 336, 325, 16/280, 284, 272, 278, 297, 296

[56] References Cited

U.S. PATENT DOCUMENTS

| | | | |
|---|---|---|---|
| 2,623,236 | 12/1952 | Borchers et al. | 16/135 |
| 3,911,529 | 10/1975 | Pringle | 16/335 |
| 4,210,979 | 7/1980 | Boyd | 16/147 |
| 4,506,409 | 3/1985 | Lautenschlager | 16/238 |
| 5,027,474 | 7/1991 | Bowers | 16/297 |
| 5,465,862 | 11/1995 | Devlin | 16/335 |
| 5,477,590 | 12/1995 | Grabher | 16/297 |
| 5,604,956 | 2/1997 | Grass | 16/278 |
| 5,617,612 | 4/1997 | Ferrari et al. | 16/278 |
| 5,765,262 | 6/1998 | Salice | 16/336 |

FOREIGN PATENT DOCUMENTS

| | | | |
|---|---|---|---|
| 1100438 | 9/1955 | France | 16/335 |
| 3218375 | 11/1983 | Germany . | |
| 4035199 | 5/1992 | Germany . | |
| 9203048 | 6/1992 | Germany . | |
| 609304 | 9/1960 | Italy | 16/335 |

*Primary Examiner*—Chuck Y. Mah
*Attorney, Agent, or Firm*—Pitney, Hardin, Kipp & Szuch LLP

[57] ABSTRACT

A snap-action hinge for the opening and closing of a furniture door includes: a cup part designed to be embedded in a recess of the door, a hinge arm designed to be fixed to the furniture unit with and having one end connected to the cup part by a hinge pin, a rigid component supported by the hinge arm in such a way as to lie parallel to the hinge pin at a defined limited distance from it measuring away from the abovementioned end, and spring means housed in the cup part and acting with a pressing action on the rigid component to allow snap-action closing of the hinge. The rigid component is advantageously made of a wear-resistant material.

9 Claims, 5 Drawing Sheets

SNAP-ACTION HINGE FOR FURNITURE DOORS

FIELD OF THE INVENTION

The present invention relates to a snap-action hinge or opening and closing furniture doors, of the type comprising a cup part designed to be embedded in the door, a hinge arm designed to be fixed to the furniture unit and having one end connected to the cup part by a hinge pin, and spring means housed in the cup part and acting on a cam supported by the hinge arm to allow snap-action closing of the hinge.

BACKGROUND OF THE INVENTION

The prior art includes the use of hinges of the sort specified above, especially in the sector of kitchen and office furniture, where the hinges are required to give good support to the doors and at the same time to ensure effective snap-action closing of the doors even after a large number of repeated actuations.

These hinges must also be simple and inexpensive to produce since, for reasons of competition, the sale price of the hinges cannot be high and they are produced industrially in large quantities.

In conventional hinges the hinged end of the hinge arm comprises an endmost eye which is made by bending part of the hinge arm itself, the eye being intended to house the hinge pin. Mounted coaxially around this end is a cam, which is generally made of a plastic material, on which the spring means are to act in order to allow snap-action closing of the hinge.

It must be pointed out, however, that the con-struction of the moulds necessary to produce a cam shaped internally so as to fit around the end of the hinge arm and externally so as to present bearing surfaces for the spring means, is not only complicated but is also no small task in itself and involves an increase in the cost of producing each hinge.

Hinges are also known in which the hinged end of the hinge arm is bent in such a way as to form, alongside a central endmost eye, two lateral portions which themselves form a cam for the spring means of the hinge.

These hinges, though simple to make, have the drawback that during opening and closing of the hinge the spring means are acting directly on, by sliding over, the above-mentioned lateral portions of the hinge arm. Accordingly, in order to prevent the performance of the hinge from being compromised after a limited number of actuations, the hinge arm is made from high-carbon temperable steels, so that the hinge arm can be subjected to thermal treatment of tempering after being formed. Clearly, however, the use of temperable steels and the need to subject the hinge arm to a final tempering treatment raises the manufacturing costs of the hinges.

The alternative solution of making the hinge arm from materials having better mechanical properties, so as to ensure good wear resistance of the lateral portions of the hinge arm without having to perform heat treatments, is not practicable owing to the fact that the hinge arm is cold-worked by mechanical deformation.

It is an object of the present invention to provide a snap-action hinge for the opening and closing of furniture doors and the like, that is simple and inexpensive to produce and has structural and functional characteristics such as to overcome the drawbacks cited above with reference to the prior art.

SUMMARY OF THE INVENTION

This object is achieved with a snap-action hinge of the sort specified which is characterized in that it comprises a rigid component supported by the hinge arm at a defined limited distance from said end so as to form said cam.

Preferably, the rigid component is made of a material resistant to sliding wear.

Preferably, the rigid component is a second pin and the hinge arm comprises an endmost eye for the hinge pin and a second eye for the second pin, said second eye being set away from the endmost eye by said defined limited distance measuring away from said end of the hinge arm, the spring means acting on at least one portion of the second pin projecting from the second eye.

BRIEF DESCRIPTION OF THE DRAWINGS

Other features and the advantages of the hinge according to the present invention will be made clear in the description given below of an embodiment thereof. This description is given as a non-limiting indication with reference to the accompanying features, in which.

DETAILED DESCRIPTION OF THE PREFERRED EMBODIMENT

Figure 1:
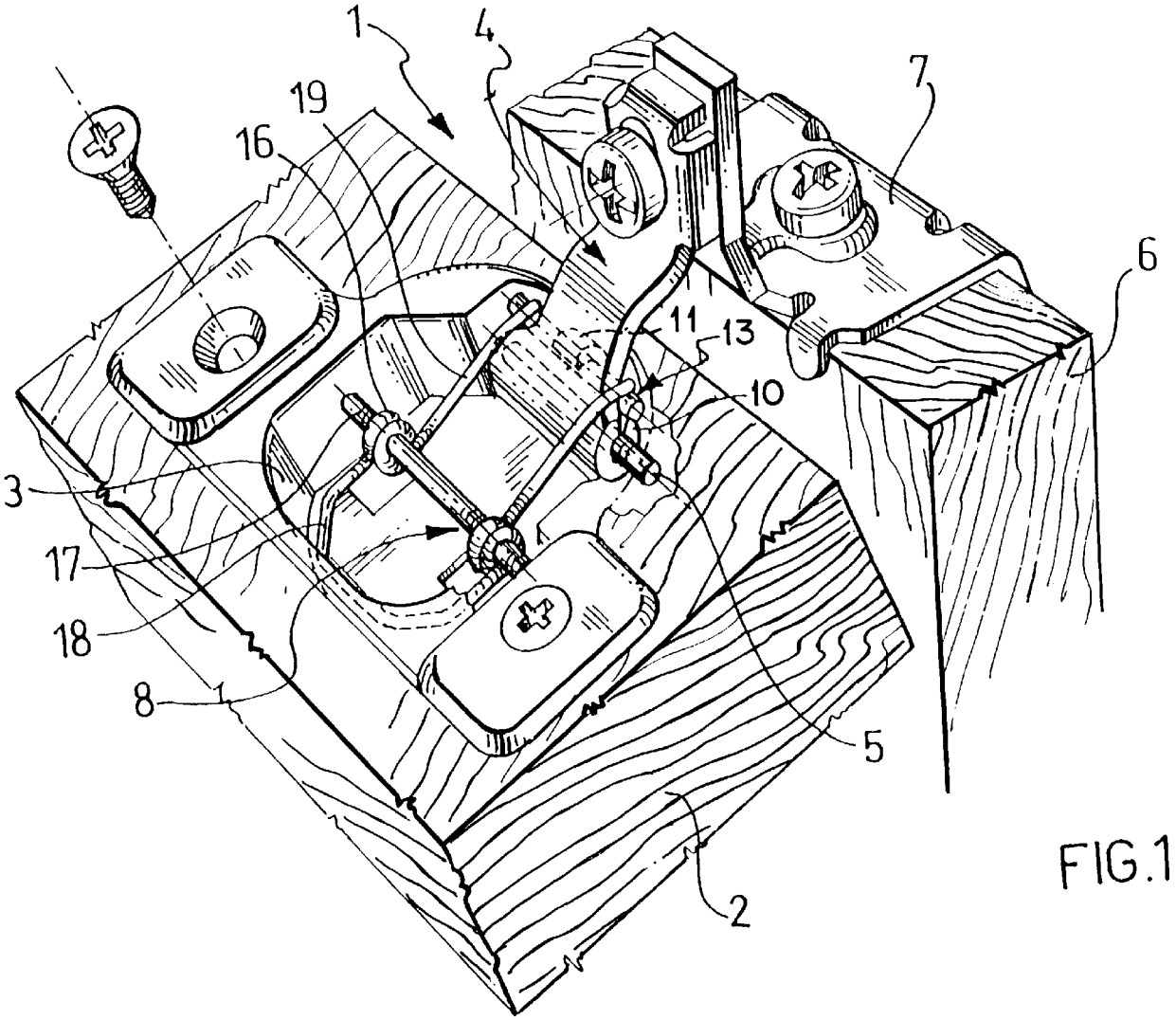
FIG. 1 is a perspective view of a hinge according to the invention.
Figure 2:
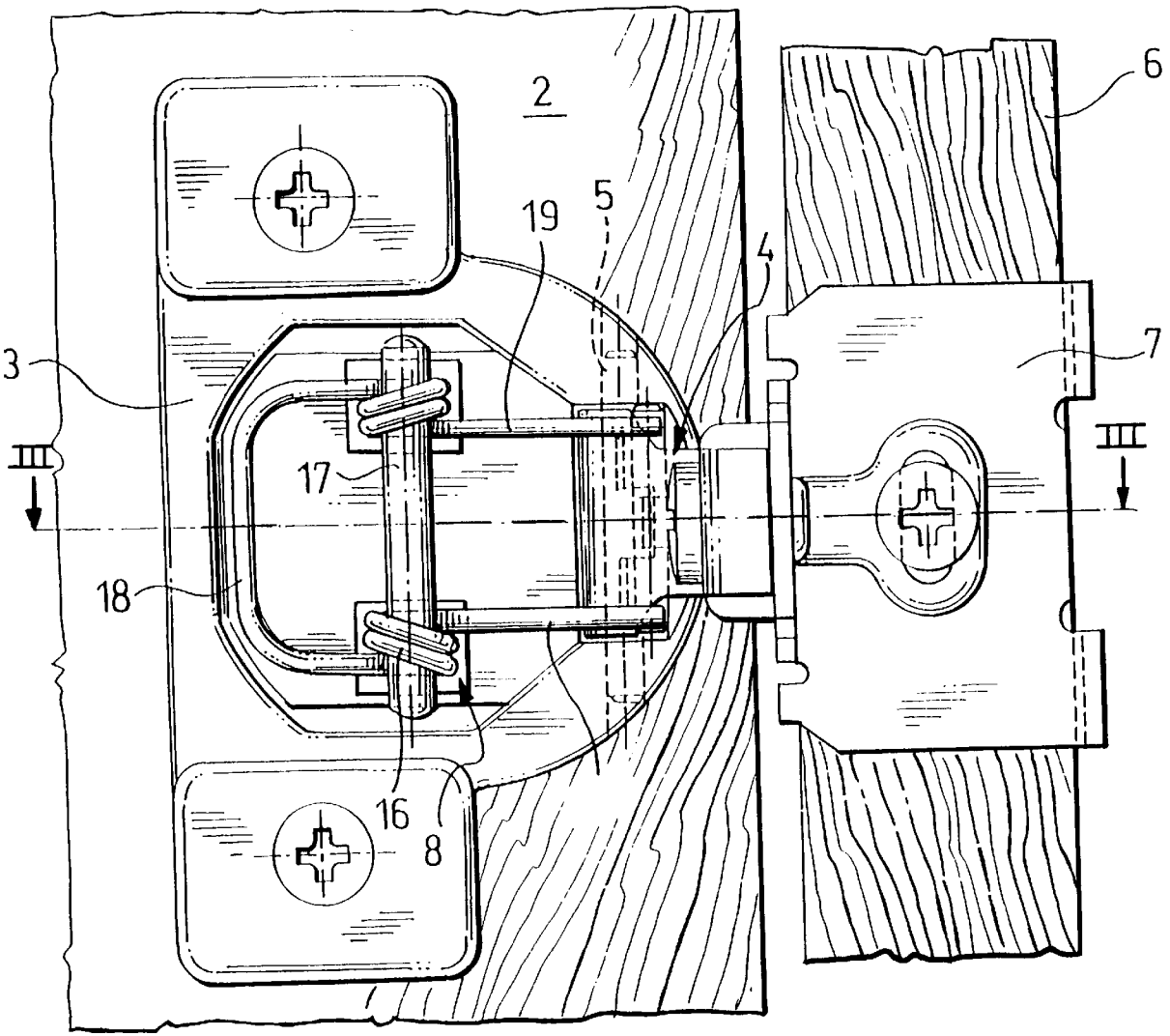
FIG. 2 is a plan view of the hinge shown in FIG. 1.

With reference to FIGS. 1 to 5, the numeral 1 is a general reference for a snap-action hinge for opening and closing a furniture door 2.

The hinge 1 comprises a cup part 3 securely embedded in an inside recess of the door 2 and a hinge arm 4. The hinge arm 4 has one end connected to the cup part 3 by a hinge pin 5 while its opposite end is fixed to an inside wall 6 of the furniture unit via an intermediate connecting plate 7.

The cup part 3 houses spring means 8 which act on the hinge arm 4 for the snap-action closing of the hinge 1.

Figure 5:
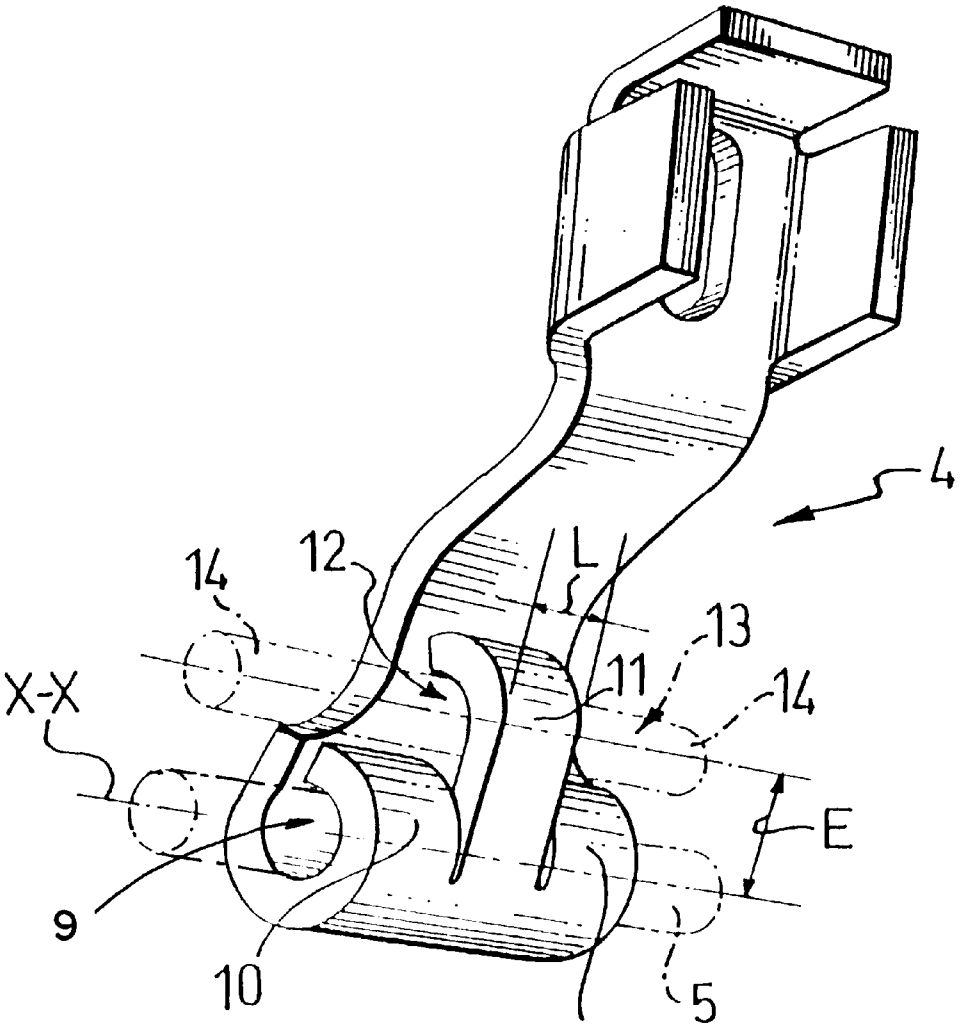
FIG. 5 is a perspective view of a detail of the hinge shown in FIG. 1.

As seen in FIG. 5, at the abovementioned connected end, the hinge arm 4 comprises an endmost eye 9, with axis X—X approximately transverse to the axis of the hinge arm 4, and a second eye 12 approximately parallel to the endmost eye 9 but set away from it by a defined distance E measuring away from the end of the hinge arm 4 (FIG. 5).

The second eye 12 extends in its axial direction for a length L less than the width of the hinge arm 4.

Figure 3:
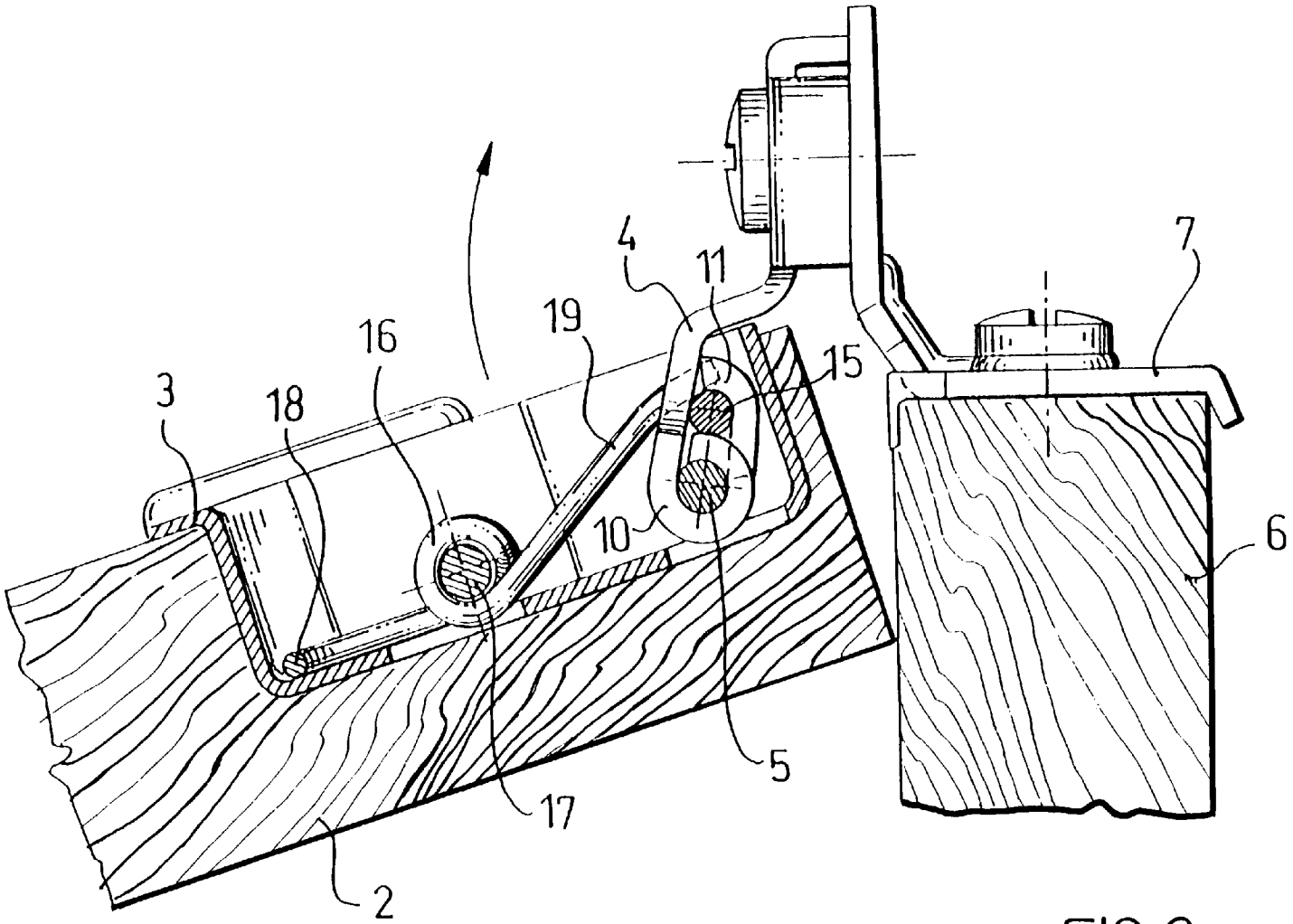
FIG. 3 is a sectional view on III—III as marked in FIG. 2, of the hinge shown in FIG. 1, FIG. 4 As a sectional view on III—III as marked in FIG. 2, of the hinge shown in FIG. 1 in a different operational position.

The endmost eye 9 is designed to house the hinge pin 5. The cup part 3 is thus angularly movable with respect to the hinge arm 4 between a position in which the hinge is closed (FIG. 4) and a position in which the hinge is open (FIG. 3).

The endmost eye 9 and the second eye 12 are preferably formed by bending a hinge arm having a rectilinear end portion in which lateral portions 10 project a defined length beyond a central portion 11. This rectilinear portion is then bent in such a way that its lateral portions 10 are bent to form the endmost eye 9 and the projecting central portion 11 defines, with respect to the endmost eye 9, the second eye 12.

Said end portion is preferably wider than the rest of the hinge arm 4, though it must still be able to fit into the cup part 3.

The hinge 1 comprises a rigid component 13 supported by the hinge arm 4 at a defined limited distance from the abovementioned connected end. The rigid component 13 forms a cam on which the spring means 8 are to act to allow snap-action closing of the hinge.

In practice, the rigid component 13 preferably takes the form of a second pin 15 inserted with a predetermined amount of force into the eye 12 in such a way as to lie parallel to the hinge pin 5 and separated from it by the distance E. The opposing ends 14 of the second pin 15 project from the second eye 12, and the spring means 8 act upon it with a pressing action. Said ends 14 of the second pin 15 thus form cams of defined eccentricity E on which the spring means 8 act to allow snap-action closing of the hinge 1.

In the example in question, the spring means 8 take the physical form of a double helical torsion spring 16 wound around another pin 17, which latter is supported by the cup part 3 and lies parallel to the hinge pin 5. The spring 16 comprises a central loop 18 which rests on and presses against the bottom of the cup part 3 and two end arms 19 which rest on and press against the ends 14 of the second pin 15. The direction of action of the spring 16 is such as to oppose the opening of the hinge 1 with a defined spring loading.

The hinge arm 4 of the hinge 1 may advantageously be made from a material that can be worked easily by cold mechanical deformation or by casting, such as for example a low-carbon steel or a Zn+Al+Mg alloy (ZAMA), while the second pin 15 is made of a material resistant to sliding wear.

Preferably, the second pin 15 is made of tempered steel.

Alternatively the second pin may be made of alloy steel.

Alternatively the second pin may be made of bronze.

Alternatively the second pin may be made of a plastic material.

Alternatively the second pin may be made of polytetrafluoroethylene (PTFE).

Figure 4:
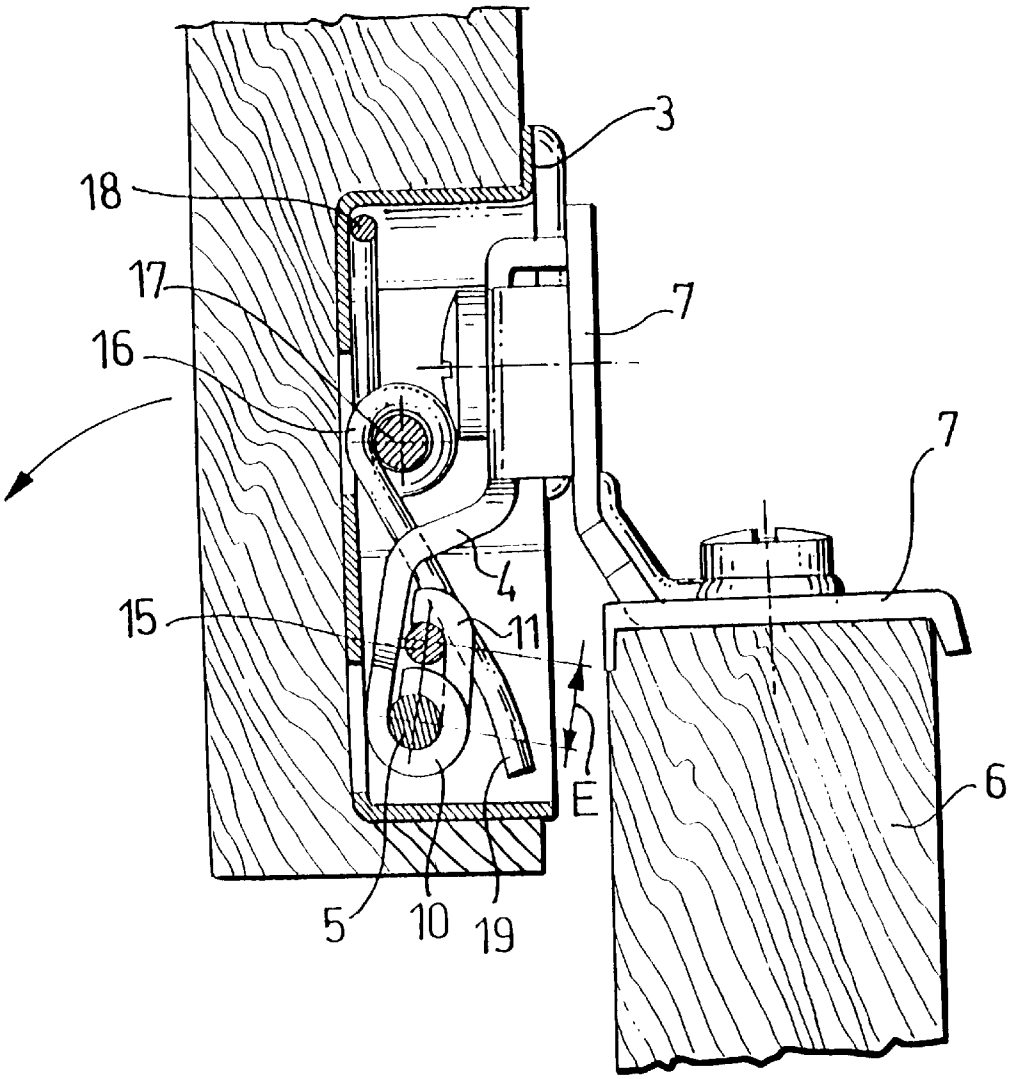

With reference to the abovementioned figures, a description will now be given of the manner in which the hinge 1 operates, from an initial position in which it, and therefore also the door 2 supported by it, is in the closed position (FIG. 4).

As described earlier, when the hinge 1 is in this position, the arms 19 of the spring 16 act with a pressing action against the ends of the second pin 15 in order to resist any rotation tending to separate the cup part 3 from the hinge arm 4 in such a way as to open the hinge 1.

The hinge 1 is opened by exerting, through the door 2, sufficient force to overcome the action of the spring 16 on the second pin 15. During the opening of the hinge 1, the cup part 3 rotates with respect to the hinge arm 4 about the hinge pin 5. During this rotation the ends 14 of the second pin 15 slide against the arms 19 of the spring 16. However, since the second pin 15 is made from a wear-resistant material, this sliding does not compromise the performance of the hinge 1 even after a large number of actuations. As this rotation of the cup 3 with respect to the hinge arm 4 continues, a dead point is reached, after which the spring 16 acts on the ends 14 of the second pin 15 in a direction tending to maintain the hinge 1 in the open position (FIG. 3). Thus, this device is a bi-stable spring having a tendency to close or open depending on which direction from the dead point the hinge is rotated.

Proceeding in the opposite direction results in the snap-action closing of the hinge.

It is worth emphasizing that the cost of manufacturing, and fitting on the hinge arm, a rigid component of the type considered above has no significant percentage effect on the total cost of the hinge, but allows the hinge to continue to perform efficiently even after a very large number of actuations.

Furthermore, the use of the abovementioned rigid component acting as a cam means that the hinge arm of the hinge can be made from inexpensive and easily worked materials by cold mechanical deformation.

As will be realized from the above description, the snap-action hinge for the opening and closing of furniture doors in accordance with the invention fulfils the requirements referred to in the introductory part of the present description and at the same time overcomes the disadvantages cited with reference to the prior art.

Obviously, in order to fulfil local and particular requirements, a person skilled in the art will be able to make many modifications to and variations of the hinge as described above, all however coming within the scope of the protection of the invention as defined by the following claims.

Thus, for example, as an alternative to what has been described, the rigid component can be replaced with some other component functionally equivalent to the second pin 15. Moreover, the rigid component 13 can be fixed to the hinge arm 4 of the hinge 1 in some other way than that described above, for example by welding.

The second eye 12 can be formed by bending the hinge arm 4 of the hinge 1 differently. The fixing of the hinge arm 4 to the inside wall 6 of the furniture unit can be carried out with the interposition of an alignment template, known per se, which enables the position of the hinge arm to be aligned with respect to the wall of the furniture unit.

What is claimed is:

1. A snap-action bi-stable hinge for the opening and closing of a furniture door attached to a furniture unit, comprising:

a cup part designed to be embedded in said furniture door, said cup part including a hinge pin fixed to said cup part, a hinge arm having a first part securable to said furniture unit and an end which is spaced from said first part and which is connected to the cup part by being pivotally engaged to and pivotable about said hinge pin, a rigid cam fixed on said hinge arm at a defined distance from said end of said hinge arm, and a spring secured in said cup part and engaging and urging said cam to allow snap-action of said snap-action bi-stable hinge in opening or closing said door.

2. A hinge according to claim 1, wherein said rigid cam is a second pin.

3. A hinge according to claim 2, wherein said hinge arm comprises a first eye at said end of said arm pivotally coupled to said hinge pin and a second eye coupled to said second pin, said second eye being off-set from said first eye by said defined distance measuring away from said end of the hinge arm, said spring means acting on at least one portion of said second pin projecting from said second eye.

4. A snap-action bi-stable hinge according to claim 1, in which said rigid component is made of a wear-resistant material.

5. A snap-action bi-stable hinge according to claim 4, in which said rigid component is made of steel.

6. A snap-action bi-stable hinge according to claim 5, in which said rigid component is made of tempered steel.

7. A snap-action bi-stable hinge according to claim 4, in which said rigid component is made of bronze.

8. A snap-action bi-stable hinge according to claim 4, in which said rigid component is made of a plastic material.

9. A snap-action bi-stable hinge according to claim 8, in which said rigid component is made of polytetrafluoroethylene.

* * * * *

UNITED STATES PATENT AND TRADEMARK OFFICE

CERTIFICATE OF CORRECTION

PATENT NO. : 6,125,508
DATED : October 3, 2000
INVENTOR(S) : Formenti, Giancarlo It is certified that error appears in the above-identified patent and that said Letters Patent is hereby corrected as shown below:

Title page,
Item [30], insert -- Feb. 28, 1997 [EP] European Patent Office.....97830083 --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*